US006498911B2

(12) United States Patent
Hiroki et al.

(10) Patent No.: US 6,498,911 B2
(45) Date of Patent: Dec. 24, 2002

(54) FIXING DEVICE WITH REDUCED POWER CONSUMPTION AND SHORTENED WARM-UP TIME

(75) Inventors: Masashi Hiroki, Yokohama (JP); Hiroshi Murata, Yokohama (JP)

(73) Assignee: Toshiba TEC Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/812,818

(22) Filed: Mar. 21, 2001

(65) Prior Publication Data

US 2002/0136562 A1 Sep. 26, 2002

(51) Int. Cl.[7] ..... G03G 15/20

(52) U.S. Cl. ..... 399/69; 219/216; 399/329; 399/333

(58) Field of Search ..... 399/69, 70, 325, 399/333, 328–330; 432/60; 219/216

(56) References Cited

U.S. PATENT DOCUMENTS 5,115,279 A * 5/1992 Nishikawa et al. ..... 219/216 X
6,021,303 A * 2/2000 Terada et al. ..... 399/328
6,324,366 B1 * 11/2001 Funayama et al. ..... 399/329 X

FOREIGN PATENT DOCUMENTS

JP 8-292669 11/1996
JP 2000-66541 3/2000

* cited by examiner

*Primary Examiner*—William J. Royer
(74) *Attorney, Agent, or Firm*—Foley & Lardner

(57) ABSTRACT

A fixing device is provided in the middle of a conveyance path for conveyance of a sheet on which a toner image is transferred. A fixing roller round which an endless fixing belt is put is provided on a top surface side of the sheet, i.e. on one side of the conveyance path. The fixing belt is longer than an outer periphery of the fixing belt. A pressurizing roller for pushing the sheet on the fixing belt is provided on a back surface side of the sheet, i.e. on the other side of the conveyance path. A halogen lamp is arranged on an outer side of a part of the fixing belt where the fixing belt is not put round the fixing roller. The toner image on the sheet is heated and fused, and pressurized on the sheet by the fixing belt, which is heated by the halogen lamp, and the toner image is fixed on the sheet. Since only the fixing roller is in contact with the inner side of the fixing belt, "escapes" of heat from the halogen lamp can be reduced, energy efficiency can be increased and the time required for the warm-up can be shortened.

18 Claims, 8 Drawing Sheets

FIXING DEVICE WITH REDUCED POWER CONSUMPTION AND SHORTENED WARM-UP TIME

BACKGROUND OF THE INVENTION

The present invention relates to a fixing device for allowing a recording medium on which a toner image is electrostatically transferred to pass therethrough, heating the toner image and pressurizing the recording medium such that the toner image is permeated on the recording medium, and fixing the toner image on the recording medium.

A device using an endless fixing belt is known as a conventional device built in a printer or a copier. In the device of this type, an endless fixing belt is put round a plurality of rollers and stretched, a pressurizing roller is arranged to pressurize the surface of the fixing belt, the fixing belt is heated, a recording medium on which a toner image is transferred is conveyed between the fixing belt and the pressurizing roller, and the toner image is heated, pressurized and thereby fixed on the surface of the recording medium.

A device disclosed in, for example, Jpn. Pat. Appln. KOKAI Publication No. 2000-66541, is known as a fixing device using a fixing belt. This fixing device is provided on a printer body so as to be detachable therefrom. This device is assembled by providing a unit in which an endless fixing belt is put round a heater-incorporated heating roller and a fixing roller, and the heating roller and the fixing roller are integrally mounted in a cover, to a device body containing a pressurizing roller so as to be detachable therefrom. The fixing belt is heated by the heater incorporated in the heating roller. A sheet on which a toner image is transferred is conveyed between the pressurizing roller and the fixing roller round which the fixing belt is put, and the toner image is fused and fixed on the sheet by heat supplied from the fixing belt. The unit can be easily exchanged and maintenance can be facilitated by mounting a unit in which members such as the fixing belt having a comparatively short life are integrally provided in the fixing device body so as to be detachable therefrom.

A device disclosed in Jpn. Pat. Appln. KOKAI Publication No. 8-292669 is also known as another fixing device using a fixing belt. In this fixing device, an endless fixing belt is put round three rollers including a drive roller and stretched, a heater is arranged inside the fixing belt, and a pressurizing roller is arranged to pressurize the drive roller by the fixing belt. The fixing belt is heated from a back side thereof by the heater. A sheet on which a toner image is transferred is conveyed between the pressurizing roller and the drive roller round which the fixing belt is put, and the toner image is fused and fixed on the sheet by heat supplied from the fixing belt.

In the device disclosed in Jpn. Pat. Appln. KOKAI Publication No. 2000-66541, since the fixing belt is heated by the heater incorporated in the heating roller, heat from the heater transmits to the heating roller, the back surface of the fixing belt and the top surface of the fixing belt in order, much time is required to raise the temperature of the surface of the fixing belt to a desired temperature, and much time is also required to warm up the fixing device. Further, for example, since heat escapes to the cover through the rotary shaft of the heating roller, more thermal energy than necessary is required to raise the temperature of the surface of the fixing belt to a desired temperature and power consumption is thereby increased.

In the device disclosed in Jpn. Pat. Appln. KOKAI Publication No. 8-292669, the belt is directly heated by the heater arranged inside the fixing belt. However, since the heat from the heater transmits to the back surface of the fixing belt and then to the top surface of the fixing belt, for example, heat escapes through rotary shafts of three rollers that are in contact with the back surface of the fixing belt, and much time and much energy are required to raise the temperature of the surface of the fixing belt to a desired temperature.

BRIEF SUMMARY OF THE INVENTION

The present invention is accomplished in consideration of the above points, and an object of the present invention is to provide a fixing device capable of reducing power consumption and shortening a warm-up time.

Another object of the present invention is to provide a fixing device which allows the only fixing belt having a comparatively short life to easily exchange and which can thereby reduce maintenance costs.

To achieve the above objects, there is provided a fixing device for allowing a sheet-like recording medium on which a developer image is transferred to pass through a conveyance path and fixing the developer image on the recording medium, the fixing device comprising:

- a first roller and a second roller arranged opposite to one another to sandwich and mutually pressurize the conveyance path, the first roller arranged on the surface side of the recording medium conveyed in the conveyance path;
- an endless belt put round a part of the first roller, for running while an outer surface thereof is in contact with the surface of the recording medium conveyed in the conveyance path, the belt being longer than an outer periphery of the first roller; and
- a heater for heating the belt.

Further, there is provided a fixing device for allowing a sheet-like recording medium on which a developer image is transferred to pass through a conveyance path and fixing the developer image on the recording medium, the fixing device comprising:

- a first roller and a second roller arranged opposite to one another to sandwich and mutually pressurize the conveyance path, the first roller arranged on the surface side of the recording medium conveyed in the conveyance path;
- an endless belt put round the first roller and stretched, for running while an outer surface thereof is in contact with the surface of the recording medium conveyed in the conveyance path;
- a third roller having an outer peripheral surface that is in contact with an inner surface of the belt, and being urged in a direction of separating from the first roller so as to apply tension to the belt, the third roller having a smaller diameter portion that is made narrow to reduce an area of the outer peripheral surface; and
- a heater for heating the belt.

Moreover, there is provided an image forming apparatus comprising:

- image forming means for forming an image of a developer on an image carrier;
- a transfer device for transferring the developer image formed by the image forming means on a surface of a sheet-like recording medium;
- a conveyance path in which the recording medium on which the developer image is transferred by the transfer device is conveyed; and a fixing device for fixing the developer image on the recording medium conveyed in the conveyance path, the fixing device comprising:

a first roller and a second roller arranged opposite to one another to sandwich and mutually pressurize the conveyance path, the first roller arranged on the surface side of the recording medium conveyed in the conveyance path;

an endless belt put round a part of the first roller, for running while an outer surface thereof is in contact with the surface of the recording medium conveyed in the conveyance path, the belt being longer than an outer periphery of the first roller; and a heater for heating the belt.

DETAILED DESCRIPTION OF THE INVENTION

Embodiments of the present invention will be explained below in detail with reference to the figures.

Figure 1:
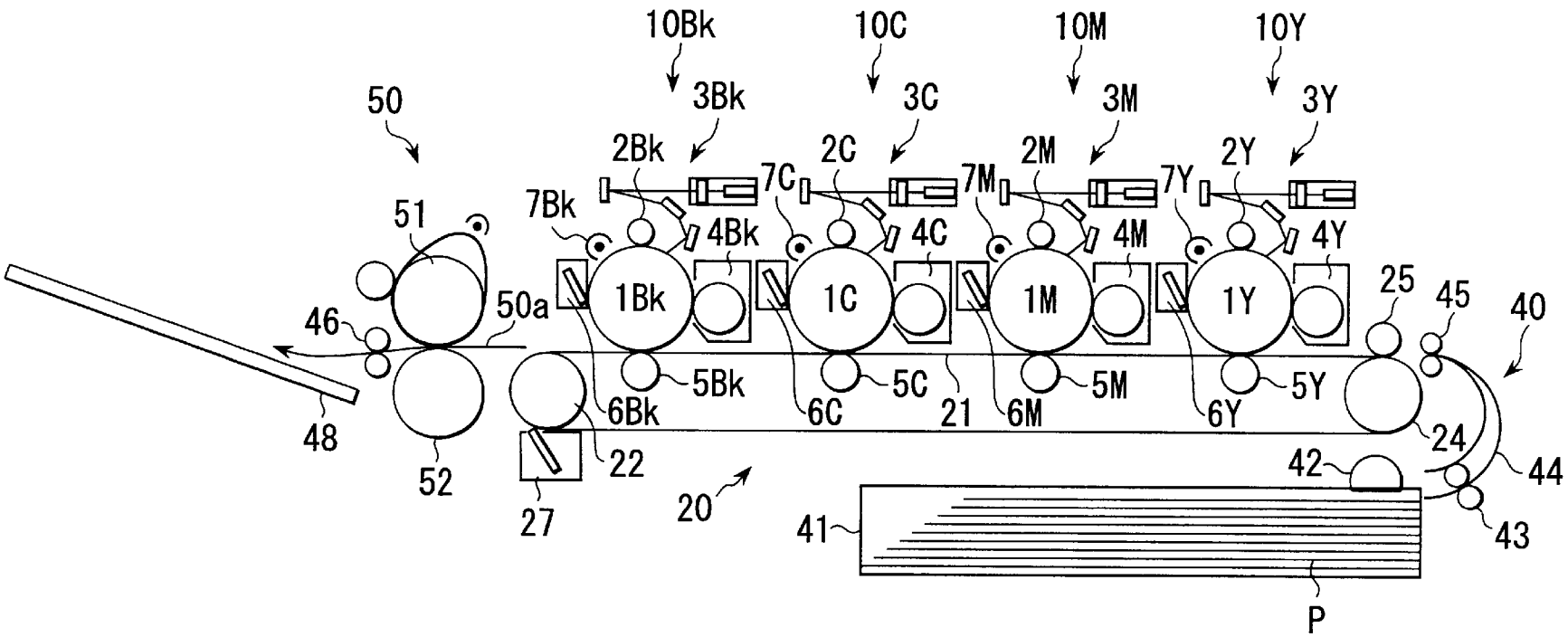
FIG. 1 shows a schematic view of essential parts of a color printer according to an embodiment of the present invention.

FIG. 1 shows a schematic view of essential parts of a four-drum-tandem type full-color printer (hereinafter simply called "printer") as an image forming apparatus according to an embodiment of the present invention.

This printer comprises four electrophotographic-type image forming units 10Y, 10M, 10C and 10Bk (image forming means) for forming toner images of four colors, yellow, magenta, cyan and black on surfaces of photosensitive drums 1Y, 1M, 1C and 1Bk (image carriers) corresponding to the respective toner images.

A conveyer mechanism 20 for conveying a sheet P (recording mediums) through the image forming units extends under the image forming units. The conveyer mechanism 20 has a drive roller 22 and a driven roller 24, which are arranged remote from one another, and an endless conveyer belt 21 put and stretched around the rollers 22 and 24. The driven roller 24 is urged in a direction of moving away from the drive roller 22 by a spring (not shown), and predetermined tension is applied to the conveyer belt 21.

The photosensitive drums 1Y, 1M, 1C and 1Bk of the image forming units 10Y, 10M, 10C and 10Bk are in contact with the conveyer belt 21 so as to be rotatable.

An adsorbing roller 25, which is in contact with an upper part of the driven roller 24 via the conveyer belt 21, is provided at a right end portion of the conveyer mechanism 20. An adsorption bias power supply (not shown) is connected to the adsorbing roller 25. A predetermined adsorption bias voltage is applied between the adsorbing roller 25 and the driven roller 24, such that the sheet P is electrostatically adsorbed on the surface of the conveyer belt 21.

A belt cleaner 27, which is in contact with the drive roller 22 via the conveyer belt 21, is provided at a left end portion of the conveyer mechanism 20. The belt cleaner 27 scrapes toner remaining on the conveyer belt 21 and cleans the surface of the conveyer belt 21.

The image forming units 10Y, 10M, 10C and 10Bk have substantially the same structure. The image forming unit 10Y for yellow color, arranged at the most upstream side of the conveying direction of the sheet P, will be explained here. The image forming units 10M, 10C and 10Bk for other colors are denoted by the same reference numerals as those of the image forming unit 10Y and their detailed explanations are omitted.

The image forming unit 10Y has the photosensitive drum 1Y, which is in contact with the conveyer belt 21 so as to be rotatable, at an approximately central position of the image forming unit 10Y. An electrifier 2Y for electrifying the surface of the photosensitive drum 1Y with a predetermined electric potential, an exposure device 3Y for exposing the electrified drum surface to light in accordance with a color-separated image signal and forming an electrostatic latent image on the drum surface, a developer 4Y for developing the electrostatic latent image by supplying yellow toner to the electrostatic latent image, a transfer roller 5Y (transfer device) for transferring the developed toner image on the sheet P conveyed by the conveyer mechanism 20, a cleaner 6Y for removing toner remaining on the drum surface, and a destaticizing lamp 7Y for removing electric charges remaining on the drum surface, are arranged around the photosensitive drum 1Y, in the order in a rotational direction of the photosensitive drum 1Y.

A paper feed mechanism 40 for feeding the sheet P onto the conveyer belt 21 is arranged on a lower right side of the conveyer mechanism 20. The paper feed mechanism 40 has a paper feed cassette 41 in which a plurality of sheets P are stacked. A pickup roller 42 for picking up the uppermost sheet P contained in the paper feed cassette 41, one after one, is provided on an upper right side of the paper feed cassette 41. Feed rollers 43 and resist rollers 45 are provided in a conveyance path 44 extending from the pickup roller 42 to the conveyer mechanism 20.

A fixing device 50 of the first embodiment, which will be explained later in detail, is arranged on a left side of the conveyer mechanism 20.

The sheet P conveyed from the conveyer mechanism 20 is conveyed in a conveyance path 50*a* extending through the fixing device 50 so as to pass through the fixing device 50.

The fixing device 50 heats and pressurizes the sheet P conveyed in the conveyance path 50*a*, i.e. the sheet P on which toner images of respective colors are superposed and transferred. Then the fixing device 50 fuses the toner images, and allows the toner images to permeate and fix on the sheet P. An output tray 48 is provided via a pair of ejecting rollers 46, in the conveyance path 50*a* of the downstream side of the fixing device 50.

Next, an image forming operation of the above-described printer will be explained.

First, in the yellow image forming unit 10Y, the surface of the photosensitive drum 1Y is electrified at a predetermined electric potential by the electrifier 2Y. A laser beam based on a color-separated yellow image signal is applied onto the electrified surface of the photosensitive drum 1Y via the exposure device 3Y. Thus, an yellow electrostatic latent image is formed on the surface of the photosensitive drum 1Y.

The formed yellow electrostatic latent image passes a development position by the rotation of the photosensitive drum 1Y. At this time, the yellow toner is supplied to the yellow electrostatic latent image via the developer 4Y, such that the yellow toner image is formed on the surface of the photosensitive drum 1Y. The yellow toner image is further conveyed by the rotation of the photosensitive drum 1Y and is made to pass a transfer position, which is in contact with the conveyer belt 21.

On the other hand, the pickup roller 42 of the paper feed mechanism 40 is rotated, and the sheet P is picked up in the conveyance path 44. After the paper P is fed through the feed rollers 43, a front edge of the sheet P abuts on nips of the resist rollers 45 and is aligned. The resist rollers 45 are rotated at the timing of conveyance of the yellow toner image and the sheet P is fed to the transfer position. At this time, the sheet P is made to pass between the conveyer belt 21 and the adsorbing roller 25, and is electrostatically adsorbed on the surface of the conveyer belt 21.

The yellow toner image conveyed to the transfer position by the rotation of the photosensitive drum 1Y is transferred onto the surface of the sheet P conveyed by the conveyer mechanism 20. At this time, the transfer bias voltage having a polarity which is reversed to the polarity of the toner is applied to the transfer roller 5Y, which is arranged on the back side of the conveyer belt 21, opposite to the transfer position, an electric field advancing the transfer roller 5Y is applied to the yellow toner image, and the yellow toner image is transferred onto the sheet P.

After the yellow toner image is transferred, the toner undesirably remaining on the surface of the photosensitive drum 1Y is removed by the cleaner 6Y. After that, the above-described process starting from the electrifying operation using the electrifier 2Y is repeated as occasion requires.

The sheet P on which the yellow toner image is transferred is made to pass through the magenta image forming unit 10M, cyan image forming unit 10C and black image forming unit 10Bk while the sheet P is kept adsorbed on the surface of the conveyer belt 21. Thus, the toner images of the respective colors are superposed and transferred on the yellow toner image on the sheet P.

The magenta image forming unit 10M, cyan image forming unit 10C and black image forming unit 10Bk are operated similarly to the yellow image forming unit 10Y and, therefore, detailed explanations thereof will be omitted here.

The sheet P on which the toner images of the four colors are superposed and transferred is conveyed to the conveyance path 50*a* passing through the fixing device 50, by the conveyer mechanism 20. The sheet P is made to pass through the fixing device 50 in the conveyance path 50*a*, and the toner images of the respective colors are fixed on the sheet P. The sheet P on which the color images are formed in the above-described manner is ejected onto the output tray 48 by the ejecting rollers 46. Thus, a series of the image forming operations is finished.

Figure 2:
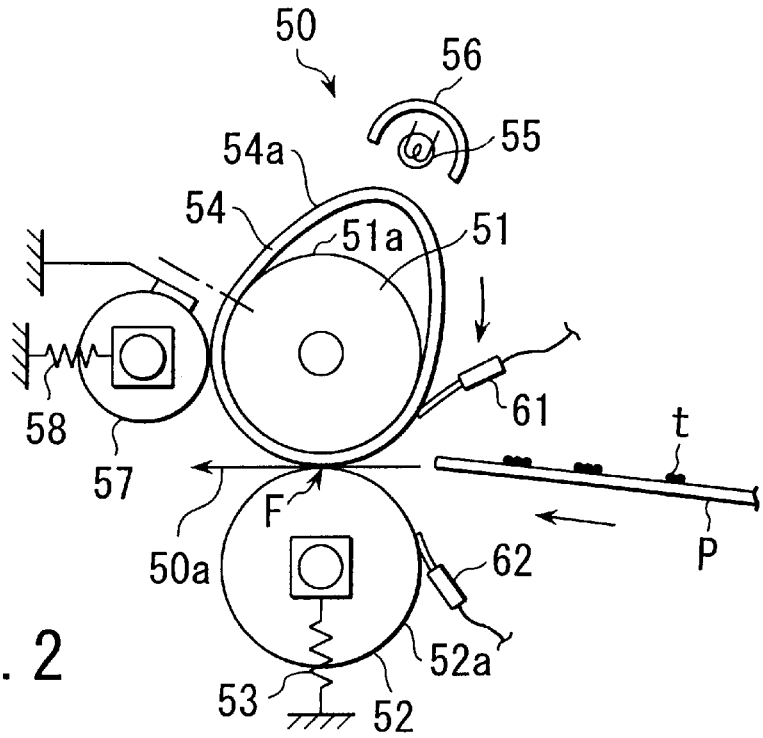
FIG. 2 shows a schematic view of a fixing device according to a first embodiment of the present invention, built in the printer of FIG. 1.

Next, the fixing device 50 according to the first embodiment of the present invention will be explained in detail with reference to FIG. 2.

The fixing device 50 has a fixing roller 51 (first roller) and a pressurizing roller 52 (second roller), which are arranged to sandwich the conveyance path 50*a*. The fixing roller 51 is formed by forming a rubber layer around a metal core. The sheet P is conveyed at a constant speed in the conveyance path 50*a* while the surface on which a toner image t is transferred faces upward. That is, the sheet P is conveyed in the conveyance path 50*a* while the top surface thereof faces the fixing roller 51 and the back surface thereof faces the pressurizing roller 52. In this embodiment, the pressurizing roller 52 is urged upward by a spring 53 so as to be pressurized toward the fixing roller 51. However, the fixing roller 51 may be pressurized toward the pressurizing roller 52 to generate a pressurizing force therebetween.

The fixing device 50 also has an endless fixing belt 54 put round the fixing roller 51. The fixing belt 54 is longer than an outer peripheral surface 51*a* of the fixing roller 51 and is put round a part of the outer peripheral surface 51*a* of the fixing roller 51. In this embodiment, the fixing belt 54 is put round about a half of the outer peripheral surface 51*a* of the fixing roller 51. The fixing belt 54 is put round the only fixing roller 51, and no other roller is arranged inside the fixing belt 54.

An outer peripheral surface 52*a* of the pressurizing roller 52 is pressurized against a part of an outer surface 54*a* of the fixing belt 54 where the fixing belt 54 is put round the fixing roller 51. That is, the fixing belt 54 is put round a part of the fixing roller 51 while the fixing belt 54 is only sandwiched between the outer peripheral surface 51*a* of the fixing roller 51 and the outer peripheral surface 52*a* of the pressurizing roller 52. The structure of the fixing belt 54 will be described later.

The fixing belt 54 put round the fixing roller 51 in this manner is made to run endlessly while the outer surface 54*a* is brought into contact with the surface of the sheet P conveyed in the conveyance path 50*a*. The outer peripheral surface 52*a* of the pressurizing roller 52 contacts the back surface of the sheet P conveyed in the conveyance path 50*a*. That is, the sheet P conveyed in the conveyance path 50*a* is made to pass through the nip between the outer surface 54*a* of the fixing belt 54 and the outer peripheral surface 52*a* of the pressurizing roller 52 and is pressurized therebetween. When the sheet P is not conveyed, the outer peripheral surface 52*a* of the pressurizing roller 52 is pressurized against the outer surface 54*a* of the fixing belt 54 and is thereby in contact therewith to form the nip between the outer surface 54*a* of the fixing belt 54 and the outer peripheral surface 52*a* of the pressurizing roller 52.

A halogen lamp 55 (heater) for heating the fixing belt 54 from the side of the outer surface 54*a* of the fixing belt 54 is arranged near the fixing belt 54. The halogen lamp 55 faces a part of the outer surface 54*a* where the fixing belt 54 is not put round the fixing roller 51. A reflector 56 having a curved surface to collect the heat from the halogen lamp 55 on the outer surface 54*a* of the fixing belt 54 is provided on the back side of the halogen lamp 55. The halogen lamp 55 and the reflector 56 extend in an axial direction of the fixing roller 51 so as to evenly heat the fixing belt 54 from the side of the outer surface 54*a* along the entire width of the fixing belt 54.

A roller 57 for applying a release agent, for example, silicone oil onto the outer surface 54*a* of the fixing belt 54 is arranged near the fixing belt 54. The roller 57 is arranged at a position which is in contact with the outer surface 54*a* of the fixing belt 54, on a part where the fixing belt 54 is put round the fixing roller 51, at the downstream side in the running direction of the fixing belt 54 from a fixing region (fixing part) F where the outer surface 54*a* of the fixing belt 54 is in contact with the surface of the sheet P conveyed in the conveyance path 50*a*, i.e. the nip between the outer surface 54*a* of the fixing belt 54 and the outer peripheral surface 52*a* of the pressurizing roller 52. The roller 57 is urged toward the fixing roller 51 with a certain pressurizing force by a spring 58.

That is, it is important that the roller 57 should continuously supply a certain amount of the silicone oil onto the outer surface 54*a* of the fixing belt 54 and should evenly apply the silicone oil onto the outer surface 54*a* thereof. For this reason, it is important to make the contact between the roller 57 and the outer surface 54*a* of the fixing belt 54 stable. In this embodiment, the roller 57 is in contact with the outer surface 54*a* of the fixing belt 54 at a part where fixing belt 54 is put round the fixing roller 51.

Further, a thermistor 61 (first sensor) for sensing a temperature of the outer surface 54*a* of the fixing belt 54 is arranged near the fixing belt 54. The thermistor 61 is arranged to face a part of the outer surface 54*a* of the fixing belt 54 where the fixing belt 54 is put round the fixing roller 51, on the upstream side in the running direction of the fixing belt 54 from the nip between the fixing belt 54 and the pressurizing roller 52. In addition, the thermistor 61 is arranged such that a sensor end thereof is in contact with the outer surface 54*a* of the fixing belt 54. Thus, the thermistor 61 is in contact with a part of the outer surface 54*a* where the fixing belt 54 is put round the fixing roller 51 and, therefore, the contact therebetween can be stably maintained and irregularity of sensed temperatures can be prevented.

In addition, another thermistor 62 (second sensor) is provided to be in contact with the outer peripheral surface 52*a* of the pressurizing roller 52. The thermistor 62 is arranged on the upstream side in the rotary direction of the pressurizing roller 52 from the nip between the pressurizing roller 52 and the fixing belt 54, and immediately before the nip.

Figure 3:
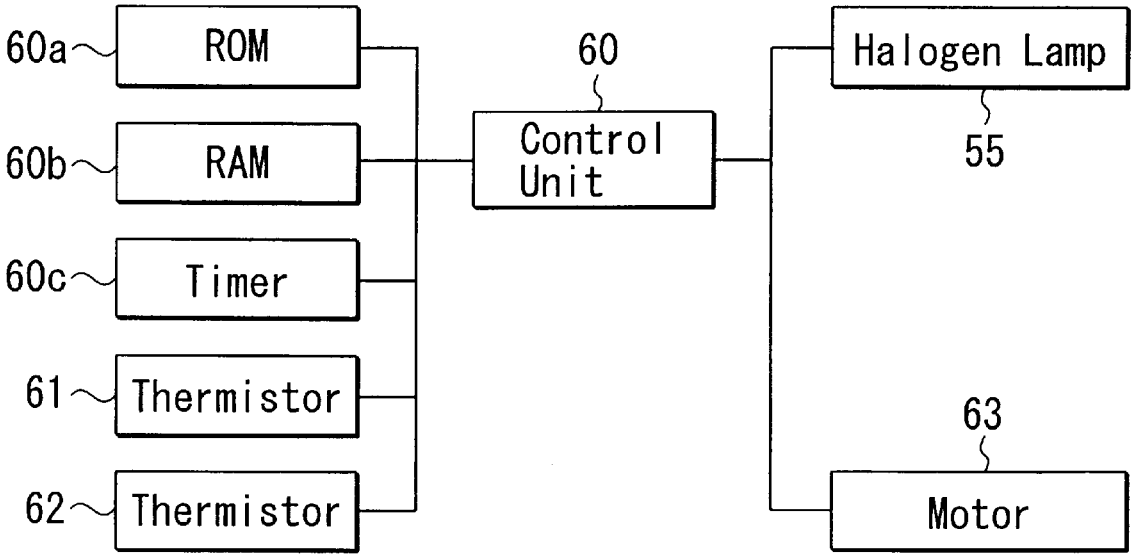
FIG. 3 shows a block diagram of a control system for controlling operations of the fixing device of FIG. 2.

FIG. 3 shows a block diagram of a control system for controlling the operations of the fixing device 50 constituted as described above. A control unit 60 (control means) for controlling the operations of the fixing device 50 is connected to a ROM 60*a* for storing a control program, a RAM 60*b* for storing a stop time t1 and a running time t2 of the fixing belt 54, which are preset with each stop/running cycle to be described later, and also for storing a temperature (first temperature) preset as an appropriate temperature of the outer surface 54*a* of the fixing belt 54 which is considered necessary for fixation and a temperature (second temperature) preset as an appropriate temperature of the outer peripheral surface 52*a* of the pressurizing roller 52 which is considered necessary for fixation, a timer 60*c* for counting the times t1 and t2, the thermistor 61 for sensing the temperature of the outer surface 54*a* of the fixing belt 54, the thermistor 62 for sensing the temperature of the outer peripheral surface 52*a* of the pressurizing roller 52, the halogen lamp 55 for heating the outer surface 54*a* of the fixing belt 54, and a motor 63 for rotating/stopping the fixing roller 51 and running/stopping the fixing belt 54. In this embodiment, the temperature of the outer surface 54*a* of the fixing belt 54 is set at 160° C. and the temperature of the outer peripheral surface 52*a* of the pressurizing roller 52 is set at 120° C. Both temperatures are different in 40° C.

The operations of the fixing device 50 will be explained here.

First, when the power of the printer is turned on, a warm-up operation of the fixing device 50 is started. In the warm-up operation, the halogen lamp 55 lights up, heating of the outer surface 54*a* of the fixing belt 54 is started, the temperature of the outer surface 54*a* of the fixing belt 54 and the temperature of the outer peripheral surface 52*a* of the pressurizing roller 52 are monitored by the thermistors 61 and 62, and the motor 63 is controlled to turn on/off in accordance with a control sequence as described later to make the fixing belt 54 intermittently stop/run. When the temperature of the outer surface 54*a* of the fixing belt 54 has reached the preset temperature stored in the RAM 60*b* and the temperature of the outer peripheral surface 52*a* of the pressurizing roller 52 has reached the preset temperature stored in the RAM 60*b*, the warm-up operation is finished. That is, the temperature of the outer surface 54*a* of the fixing belt 54 and the temperature of the outer peripheral surface 52*a* of the pressurizing roller 52 are effectively raised up to the respective set temperatures necessary for the fixation by the warm-up operation.

When the warm-up operation has been finished, the sheet P on which the toner images of respective colors are transferred is fed in the conveyance path 50*a*. The sheet P is made to pass through the nip between the fixing belt 54 and the pressurizing roller 52, and a fixing operation is executed to fix the toner images of respective colors on the sheet P. In the fixing operation, the fixing belt 54 runs at a constant speed while the outer surface 54*a* of the fixing belt 54 whose temperature is raised to the set temperature by the above-described warm-up operation is pressurized on the top surface of the sheet P conveyed in the conveyance path 50*a*. The pressurizing roller 52 is made to rotate while the outer peripheral surface 52*a* of the pressurizing roller 52 whose temperature is raised to the set temperature by the above-described warm-up operation is pressurized on the back surface of the sheet P conveyed in the conveyance path 50*a*. The toner image t is heated and fused, and pressurized and permeated on the surface of the sheet P. The sheet P on which the toner image t is permeated in this manner is naturally cooled after passing through the nip, and the fixing operation of the toner image is finished. The sheet P on which the toner image is fixed is ejected onto the output tray 48 by the pair of ejecting rollers 46.

Incidentally, in the warm-up operation, the heat from the halogen lamp 55 is transferred to each member as explained below. The heat from the halogen lamp 55 is collected on the outer surface 54*a* of the fixing belt 54 and transferred to the outer surface 54*a* of the fixing belt 54, by the reflector 56. The heat transferred to the outer surface 54*a* of the fixing belt 54 is transferred to the inner surface of the fixing belt 54 in the direction of thickness thereof and reaches the inner surface of the fixing belt 54. The heat transferred to the inner surface of the fixing belt 54 is transferred to the outer peripheral surface 51*a* of the fixing roller 51, which is in contact with the inner surface of the fixing belt 54. The heat transferred to the outer peripheral surface 51*a* of the fixing roller 51 is transferred to emit to the casing of the printer through the rotary shaft of the fixing roller 51.

In addition, the heat transferred to the outer surface 54*a* of the fixing belt 54 is transferred to the outer peripheral surface 52*a* of the pressurizing roller 52 via the nip and then to the roller 57 and the thermistor 61, which are arranged to be in contact with the outer surface 54*a* of the fixing belt 54, by making the fixing belt 54 run. The heat transferred to the pressurizing roller 52 is transmitted to emit to the casing of the printer through the rotary shaft or the spring 53, or transferred to the thermistor 62, which is arranged to be in contact with the outer peripheral surface 52*a*.

The heat directly related with the fixation of the toner image, of the heat transferred to the members, is the heat transferred from the outer surface 54*a* of the fixing belt 54 to the top surface of the sheet P and the heat transferred from the outer peripheral surface 52*a* of the pressurizing roller 52 to the back surface of the sheet P. The heat transferred to the other members is not used for the fixation and is wasted. A certain pressure caused by the nip is required for the fixation of the toner image as well as the heat.

That is, the conditions of fixing the toner image t on the sheet P slightly change in accordance with the physical properties of the toner, the material of the sheet P, the conveyance speed of the sheet P, and the like. However, it is necessary to pressurize the fixing belt 54 and the pressurizing roller 52 with a certain pressurizing force to form the nip having a determined width between the fixing belt 54 and the pressurizing roller 52, raise the temperature of the outer surface 54*a* of the fixing belt 54 to the set temperature and raise the temperature of the outer peripheral surface 52*a* of the pressurizing roller 52 to the set temperature. If these conditions are not satisfied, for example, if the outer surface 54*a* of the fixing belt 54 is heated inadequately, fixation failure will be caused.

Incidentally, to reduce power consumption required for the warm-up operation as much as possible and reduce the time spent for the warm-up operation as much as possible, which is the object of the present invention, the temperature of the outer surface 54*a* of the fixing belt 54 and the temperature of the outer peripheral surface 52*a* of the pressurizing roller 52 should preferably be raised efficiently to the it respective set temperatures. Further, simultaneously raising both temperatures to the respective set temperatures is most efficient.

This embodiment reduces as much heat emitted through the member (fixing roller 51 in this embodiment) in contact with the fixing belt 54 as possible, by employing the structure in which rollers other than the fixing roller 51 are not provided inside the fixing belt 54 and the only fixing roller 51 is made to be in contact with the inner surface of the fixing belt 54. Thus, it is thereby possible to reduce "escapes" of the heat emitted from the fixing belt 54 and to raise the temperature of the fixing belt 54 efficiently with little heat energy in a short time, as compared with the above-described conventional device disclosed in Jpn. Pat. Appln. KOKAI Publication No. 2000-66541 and Jpn. Pat. Appln. KOKAI Publication No. 8-292669, i.e. the device in which an endless fixing belt is put round a plurality of rollers. For this reason, consequently, it is possible to reduce the power consumption and also reduce the time required for the warm-up operation.

In addition, this embodiment employs a new structure of the fixing belt 54 as additional means for reducing the "escapes" of heat. The fixing belt 54 is formed to have a three-layer structure as shown in FIG. 4.

Figure 4:
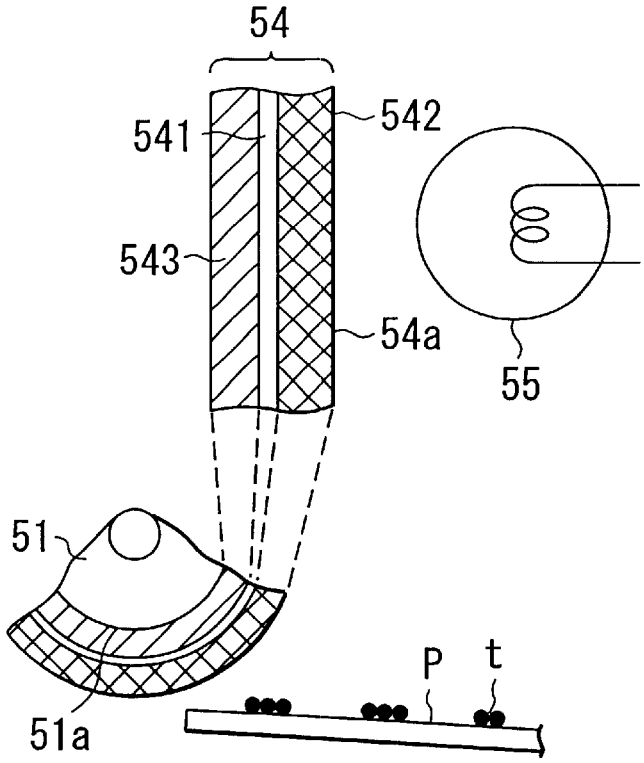
FIG. 4 shows a partially sectional view illustrating a fixing belt built in the fixing device of FIG. 2.

As shown in FIG. 4, the fixing belt 54 of this embodiment is formed by applying silicon rubber containing silicone oil with thickness of 200 $\mu$m to the outside of a base film 541 formed of a resin material such as polyimide with thickness of 100 $\mu$m to form an elastic layer 542, and applying silicon rubber having smaller degree of hardening of rubber and, at least, greater thickness than the elastic layer 542 to the inside of the base film 541 to form a heat insulation layer 543.

The base film 541 is required to have heat resistance and mechanical strength. Metals such as Ni and SUS may be used as the base film 541. The elastic layer 542 forming the outer surface 54*a* of the fixing belt 54 may be formed of a material, which is excellent in releasability of toner t and friction to the sheet P, which can evenly apply heat and pressure to the toner t and the sheet P, and which can achieve stable fixing characteristics. The material of the elastic layer 542 is not limited to silicon rubber.

The heat insulation layer 543 may be formed of a material, which has elasticity enough to easily put the fixing belt 54 around the outer peripheral surface 51*a* of the fixing roller 51 and which is excellent in heat insulation. The material of the heat insulation layer 543 is not limited to silicon rubber. Adequate effect of heat insulation can be obtained even if the heat insulation layer 543 is not provided inside the base film 541 as seen in this embodiment, but the base layer 541 formed of polyimide having substantially the same thermal conductivity as that of silicon rubber is made to be thicker. However, if the base film 541 having high mechanical strength is made to be thicker, the base film 541 will be more hardened and cannot be put round the fixing roller 51.

Thus, by forming the heat insulation layer 543 on the inner side of the fixing belt 54, it is possible to prevent heat from escaping to the only member arranged to be in contact with the inner surface of the fixing belt 54, i.e. the fixing roller 51, raise the temperature of the fixing belt 54 more efficiently, further reduce the power consumption and further reduce the warm-up time.

Figure 5:
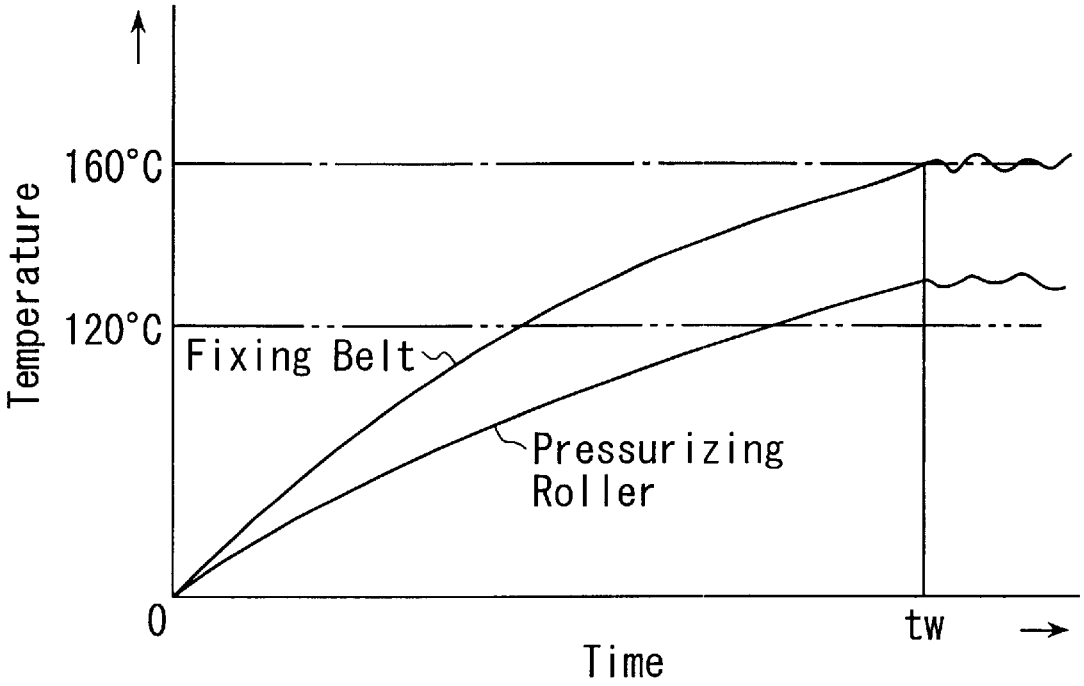
FIG. 5 shows a graph illustrating an example of temperature variation over time on an outer surface of the fixing belt and on an outer peripheral surface of a pressurizing roller in a case of starting heating the fixing belt of FIG. 4 and making the fixing belt run at a constant speed.

FIG. 5 shows a graph illustrating, as reference, the temperature variation over time on the outer surface 54*a* of the fixing belt 54 and on the outer peripheral surface 52*a* of the pressurizing roller 52, in a case of turning on the halogen lamp 55 and making the fixing belt 54 run at a constant speed in the warm-up operation of the fixing device 50. It can be understood from this graph that the temperature of the outer peripheral surface 52*a* of the pressurizing roller 52 has reached the set temperature (120°) before the temperature of the outer surface 54*a* of the fixing belt 54 reaches the set temperature (160°). In this case, after the temperature of the outer peripheral surface 52*a* of the pressurizing roller 52 has reached the set temperature, the thermal energy further transmitted to the pressurizing roller 52 is wasted.

Figure 6:
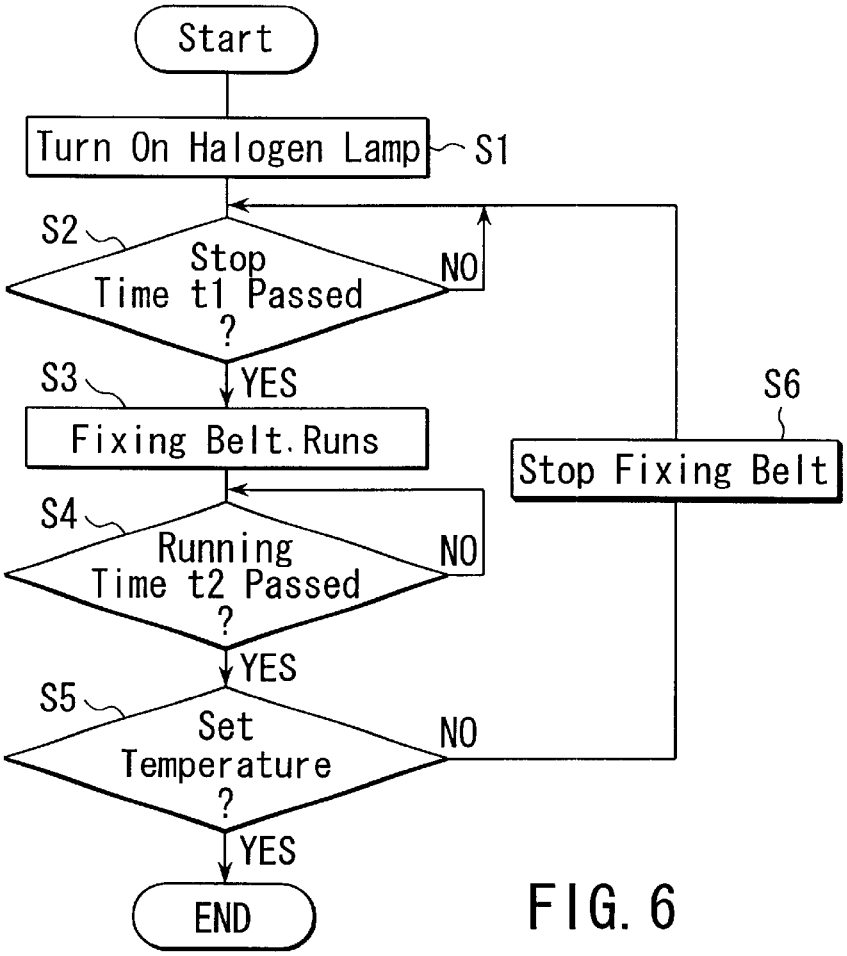
FIG. 6 shows a flow chart of control operations at a control unit of FIG. 3.

For this reason, to prevent the above-described waste of the thermal energy in the warm-up time of the fixing device 50, this embodiment employs a control method as explained below, such that the temperature of the outer surface 54*a* of the fixing belt 54 reaches the set temperature and, at the same time, the temperature of the outer peripheral surface 52*a* of the pressurizing roller 52 has reached the set temperature. The control method of the present invention will be explained below with reference to a flow chart shown in FIG. 6.

First, the power supply of the printer is turned on, the warm-up operation is started and the halogen lamp 55 is turned on (step S1). At this time, the motor 63 for making the fixing belt 54 run is stopped and thus the fixing belt 54 does not run. Preset stop time t1 of the fixing belt 54 is counted. When the time t1 has passed (step S2; YES), running of the fixing belt 54 is started (step S3).

When the fixing belt 54 runs, the part of the outer surface 54*a* heated by the halogen lamp 55 is made to pass through the nip between the outer surface 54*a* and the outer peripheral surface 52*a* of the pressurizing roller 52 at a plurality of times, the other part of the fixing belt 54 is heated, and the heat of the fixing belt 54 starts transmitting to the pressurizing roller 52. In other words, heat is not transmitted to the pressurizing roller 52 until the running of the fixing belt 54 starts at step S3. The pressurizing roller 52 is prevented from being unnecessarily heated prior to the fixing belt 54, by stopping the fixing belt 54 for a certain time as seen at step S2.

After the fixing belt 54 starts running at step S3, preset running time t2 of the fixing belt 54 is counted. When the time t2 has passed (step S4; YES), the temperature of the outer surface 54*a* of the fixing belt 54 monitored by the thermistor 61 and the temperature of the outer peripheral surface 52*a* of the pressurizing roller 52 monitored by the thermistor 62 are confirmed (step S5). If it is recognized that the temperatures detected by the thermistors 61 and 62 have reached the respective set temperatures (step S5; YES), the warm-up operation is finished and the fixing operation becomes in a standby state.

However, even if the stop time t1 and the running time t2 are adjusted, it is difficult to simultaneously raise the temperatures of the fixing belt 54 and the pressurizing roller 52 to the desired set temperatures, respectively, by executing the above-described stop/running cycle of steps S2 to S5 at only one time, since factors such as temperature variation in the device atmosphere, irregularity in the devices in the heat transmission path, and the like cannot be excluded. For this reason, it is desirable to set the range of temperature to be raised by executing the one-cycle operation of steps S2 to S5 at one time to be rather low, i.e., set the stop time t1 and running time t2 to be rather short, and raise the temperatures of the fixing belt 54 and the pressurizing roller 52 to the respective set temperatures by operations of a plurality of cycles.

In this case, if the result of detection executed by the thermistors 61 and 62 is confirmed at the end of each cycle and the detected temperatures do not reach the set temperatures (step S5; NO), the running of the fixing belt 54 is stopped (step S6) and the operation returns to the process of step S2. When the detected temperatures reach the set temperatures (step S5; YES) after the operations of a plurality of cycles, the warm-up operation is finished.

The stop time t1 and the running time t2 can be set to vary from cycle to cycle.

Figure 7:
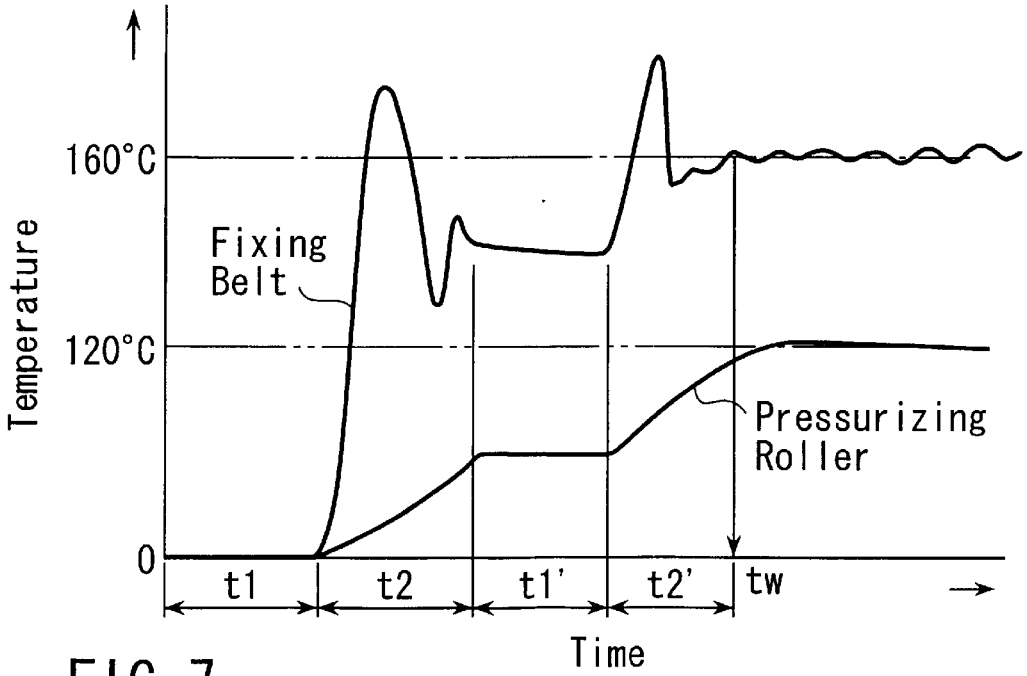
FIG. 7 shows a graph illustrating temperature variation on the outer surface of the fixing belt and the outer peripheral surface of the pressurizing roller at an operating time, on the basis of the flow chart of FIG. 6.

FIG. 7 shows an example of control operation in which the temperatures of the outer surface 54*a* of the fixing belt 54 and the outer peripheral surface 52*a* of the pressurizing roller 52 are simultaneously raised respectively to the set temperatures by repeating the above-described loop of steps S2 to S5 in two cycles. In this control operation, the stop time t1 and the running time t2 are set to vary from cycle to cycle.

In the graph of FIG. 7, at the stop time t1 of a first cycle, the fixing belt 54 is stopped though a part of the outer surface 54*a* of the fixing belt 54 is kept heated and, therefore, the locally heated part of the outer surface 54*a* does not pass through the thermistor 61. For this reason, the temperature detected by the thermistor 61 does not vary and is approximately an ambient temperature. Naturally, heat is not transmitted to the pressurizing roller 52 or the temperature detected by the thermistor 62 does not vary since the fixing belt 54 does not run.

If the running of the fixing belt 54 starts at the running time t2 of the first cycle, heating the other part of the fixing belt 54 is started, and the locally heated part of the fixing belt 54 passes through the thermistor 61 at many times. The temperature detected by the thermistor 61 is thereby raised radically. Naturally, transmission of heat to the pressurizing roller 52 is also started, and the temperature of the outer peripheral surface 52*a* of the pressurizing roller 52 is gradually raised. The temperature of the outer surface 54*a* of the fixing belt 54 is lowered in the latter half of the running time t2. The reasons will be that heat escapes to the pressurizing roller 52 and that heat of the part excessively heated during the stop time t1 disperses to the other parts.

When the temperatures detected by the thermistors 61 and 62 are confirmed and the running of the fixing belt 54 is stopped in the end of the first cycle, the temperatures detected by the thermistors 61 and 62 are slightly lowered in a stop time t1' of the second cycle, which is differentiated from the stop time t1 of the first cycle. In a running time t2' of the second cycle, which is differentiated from the running time t2 of the first cycle, the temperature of the outer surface 54*a* of the fixing belt 54 and the temperature of the outer peripheral surface 52*a* of the pressurizing roller 52 are raised, as seen in the running time t2 of the first cycle. The warm-up condition is finished, under the condition that the temperature of the outer surface 54*a* of the fixing belt 54 and the temperature of the outer peripheral surface 52*a* of the pressurizing roller 52 reach the respective set temperatures in the end of the second cycle.

If the fixing belt 54 is made to run intermittently as explained in the above embodiment, the temperature of the outer surface 54*a* of the fixing belt 54 can be raised to the desired set temperature and, simultaneously, the temperature of the outer peripheral surface 52*a* of the pressurizing roller 52 can be raised to the desired set temperature. Thus, no thermal energy is wasted, the power consumption is reduced and the warm-up time is shortened.

Figure 8:
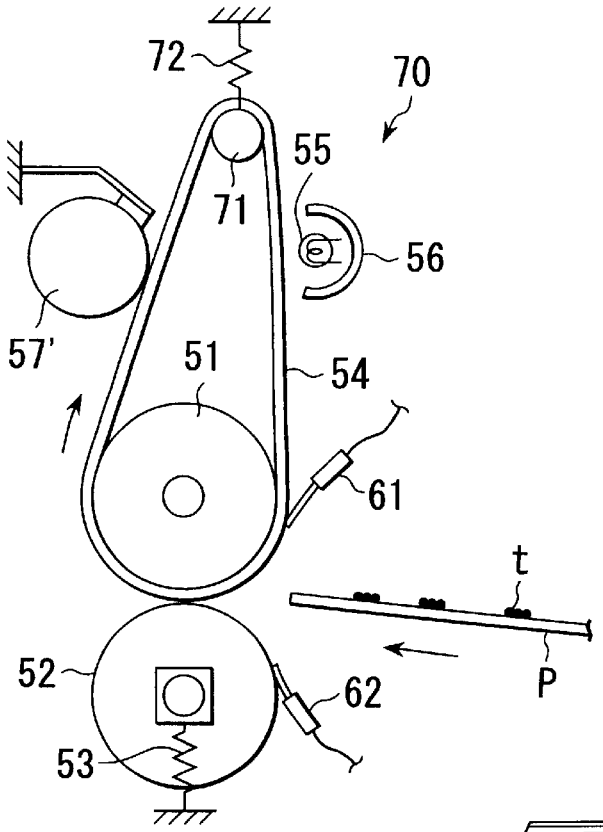
FIG. 8 shows a schematic view of a fixing device according to a second embodiment of the present invention.

Next, a fixing device 70 of a second embodiment will be explained below with reference to FIG. 8. The constituent elements functioning similarly to the fixing device 50 of the first embodiment are denoted by the same reference numerals, and detailed explanations thereof are omitted.

The fixing device 70 comprises a tension roller 71 (a third roller) as well as the fixing roller 51, inside the fixing belt 54. The tension roller 71 is arranged to separate upwardly from the fixing roller 51 and is urged in a direction of separating from the fixing roller 51 by a spring 72. That is, in this embodiment, the fixing belt 54 is put round the fixing roller 51 and the tension roller 71 and is stretched while a predetermined tension is applied to the fixing belt 54. Thus, the fixing belt 54 can be made to run stably, as compared with the first embodiment. In this embodiment, a roller 57' for applying silicone oil onto the outer surface 54*a* of the fixing belt 54 is made to be in contact with the outer surface 54*a*, at a part of the fixing belt 54 which is not put round the fixing roller 51. In this case, the spring 58 (see FIG. 2) for urging the roller 57' toward the fixing belt 54 is unnecessary.

As explained in the first embodiment, however, it is desirable to reduce as many members in contact with the inner surface of the fixing belt 54 as possible, in order to efficiently raise the temperature of the fixing belt 54. To solve this problem, in this embodiment, the newly added tension roller 71 reduces as many areas where the tension roller 71 is in contact with the inner surface of the fixing belt 54 as possible.

Figure 9:
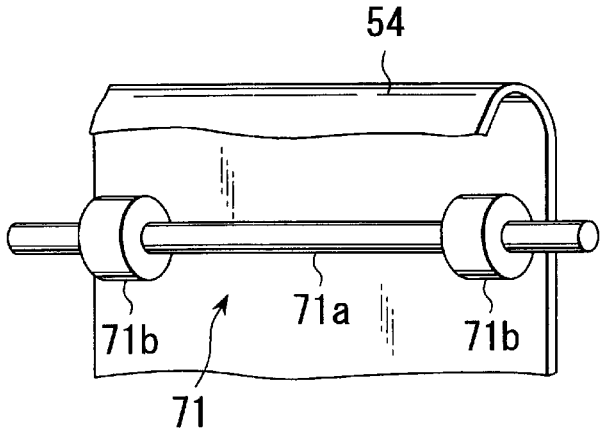
FIG. 9 shows a partial perspective view illustrating a tension roller built in the fixing device of FIG. 8.

For example, as shown in FIG. 9, roller portions 71*b* provided near both ends of the tension roller 71 along a rotary shaft 71*a* of the tension roller 71 are left, and the inner surface of the fixing belt 54 is made to be in contact with the peripheral surfaces of the two roller portions 71*b* and wound round the roller portions 71*b*, so as to reduce as many contact areas between the tension roller 71 and the fixing belt 54 as possible. In this case, it is possible to remarkably restrict the transmission of the heat from the fixing belt 54 and efficiently raise the temperature of the fixing belt 54 without losing the function of the tension roller 71.

Figure 10:
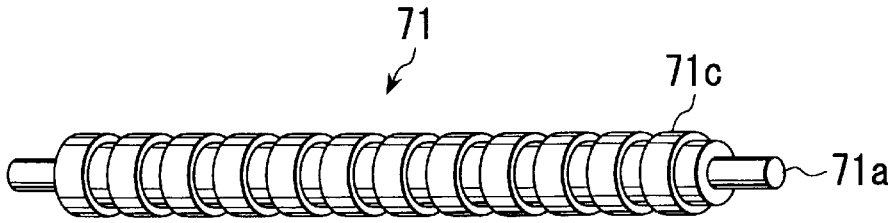
FIG. 10 shows a perspective view illustrating a modified example of the tension roller.

Moreover, as shown in FIG. 10, a plurality of roller portions 71*c* may be provided with constant intervals disposed between two of them along the rotary shaft 71*a* of the tension roller 71. The same advantage can be obtained from the roller portions 71*c*.

Next, a fixing device 80 according to the other embodiment of the present invention will be explained with reference to FIGS. 11 to 14.

Figure 11:
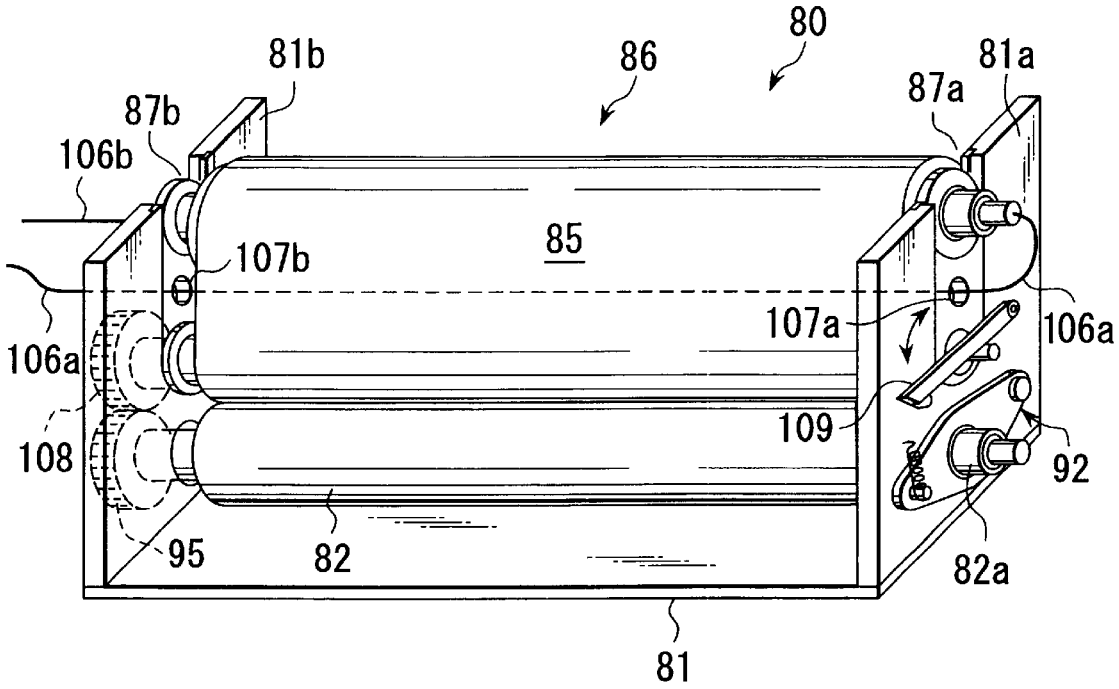
FIG. 11 shows a perspective view of a fixing device according to the other embodiment of the present invention.

As shown in FIG. 11, the fixing device 80 has a casing 81 as a frame of the device. The casing 81 has two side wall portions 81*a* and 81*b* formed by bending both sides of a substantially rectangular plate at 90° in the same direction. A pressurizing roller 82 is provided near a bottom portion of the casing 81. Both ends of the pressurizing roller 82 are attached to the side wall portions 81*a* and 81*b* of the casing 81 so as to allow the pressurizing roller 82 to freely rotate. A belt unit 86 is provided above the pressurizing roller 82 as a unit of a fixing roller 83, a heating roller 84 and a fixing belt 85. Groove holes 87*a* and 87*b* are formed on the side wall portions 81*a* and 81*b* of the casing 81, such that both ends of the belt unit 86 are detachably fitted in the groove holes 87*a* and 87*b*.

Figure 12:
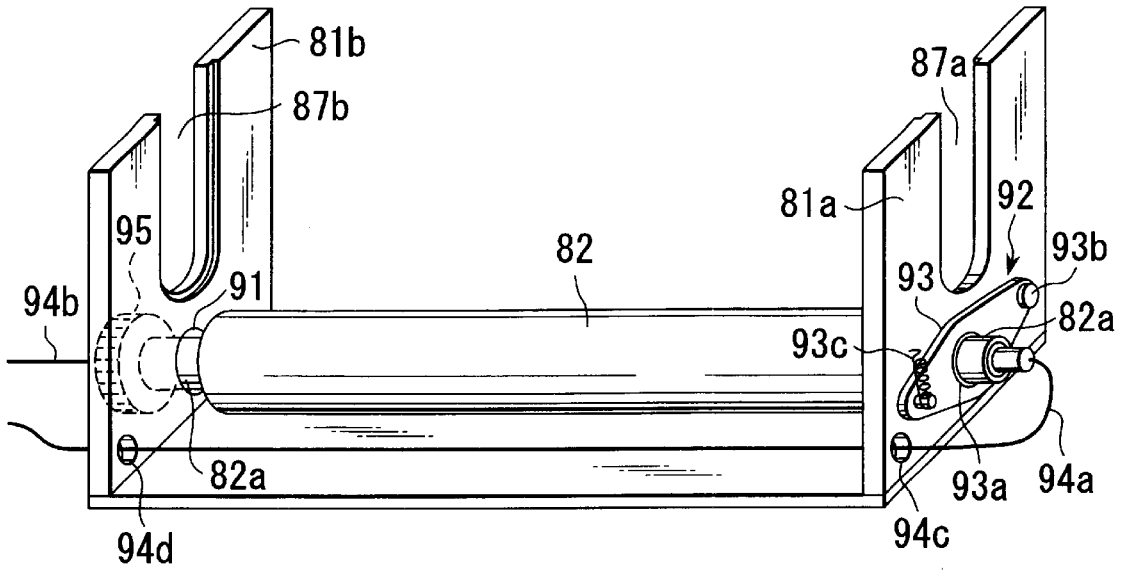
FIG. 12 shows a perspective view of the fixing device of FIG. 11 from which a belt unit is detached.

In FIG. 12, the belt unit 86 is detached from the groove holes 87*a* and 87*b* of the casing 81. Holes 91 through which both ends of a rotary shaft 82*a* of the pressurizing roller 82 pass are formed on the respective side wall portions 81*a* and 81*b* of the casing 81. Each of the holes 91 holds the rotary shaft 82*a* of the pressurizing roller 82 such that the pressurizing roller 82 can be rotated, and has little play such that the rotary shaft thereof can slightly move laterally. That is, each hole 91 is elongated at least laterally.

On the rotary shaft 82*a* passing through the hole 91 (not shown) of one of the side wall portions 81*a*, an urging mechanism 92 for upwardly urging the rotary shaft 82*a* is provided. An urging mechanism 92 is also provided on the other side wall portion 81*b*, but illustration of the urging mechanism 92 in the figure is omitted.

The urging mechanism 92 has, on a substantially central part thereof, a plate 93 having a hole 93*a* through which the rotary shaft 82*a* of the pressurizing roller 82 passes. An end of the plate 93 is rotatably attached to the outer surface of the side wall portion 81*a* by a pin 93*b*, and a spring 93*c* is provided between the other end of the plate 93 and the side wall portion 81*a*. The plate 93 is rotated around the pin 93*b* by the urging force of the spring 93*c*, so as to upwardly urge the rotary shaft 82*a* of the pressurizing roller 82 accepted in the hole 93*a*. That is, the pressurizing roller 82 is always urged upwardly by the spring 93*c*.

Cables 94*a* and 94*b* extend respectively from both ends of the pressurizing roller 82. In this embodiment, the pressurizing roller 82 includes a halogen lamp (not shown) and the cables 94*a* and 94*b* of the halogen lamp extend from both ends of the pressurizing roller 82. The cable 94*a* extending from one end of the pressurizing roller 82 passes toward the other end side through holes 94*c* and 94*d* formed on the respective side wall portions 81*a* and 81*b* of the casing 81.

A gear 95 for transmitting a rotary drive force from a motor (not shown) is attached to the rotary shaft 82*a* of the pressurizing roller 82, which passes through the hole 91 of the other side wall portion 81*b*.

Figure 13:
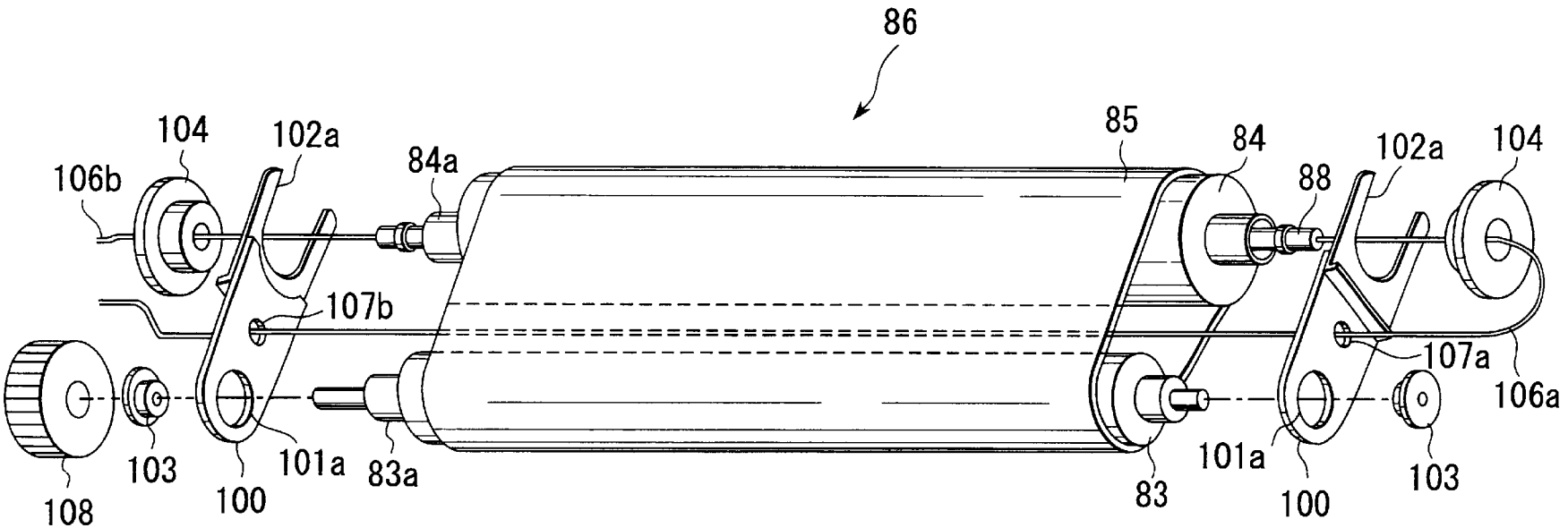
FIG. 13 is an exploded perspective view of the belt unit built in the fixing device of FIG. 11.
Figure 14:
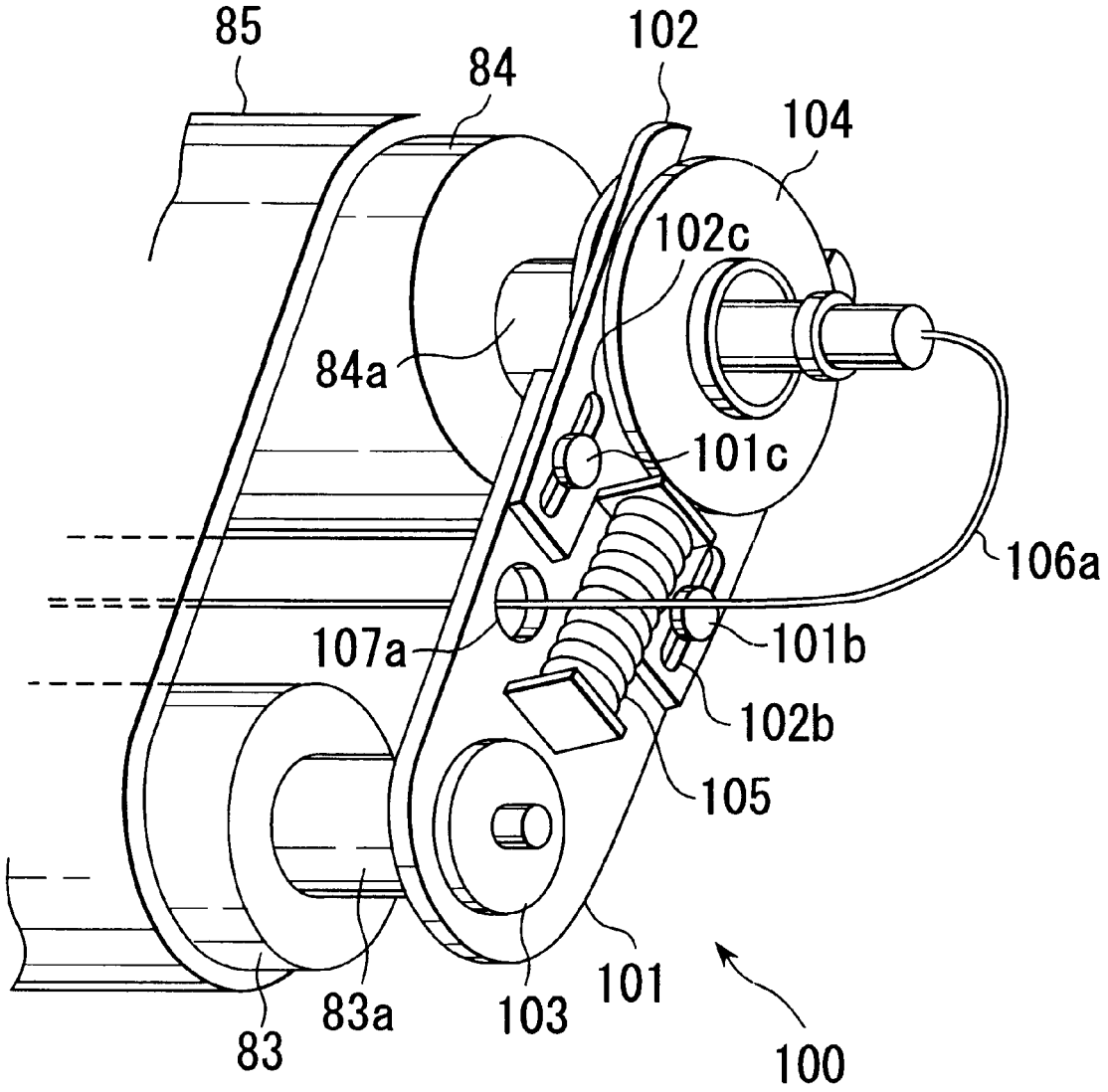
FIG. 14 is a partially enlarged view of an end portion of the belt unit shown in FIG. 13.

FIG. 13 is an exploded perspective view of the belt unit 86. FIG. 14 is a partially enlarged view of one end portion of the belt unit 86.

The belt unit 86 is formed by putting the endless fixing belt 85 around the fixing roller 83 and the heating roller 84, which are aligned parallel and separated from one another, and by attaching movable frames 100 on both sides. The heating roller 84 includes a halogen lamp 88. The halogen lamp 88 heats the fixing belt 85, which is put around the heating roller 84.

Each movable frame 100 has a first frame 101 and a second frame 102. The first frame 101 has a substantially circular hole 101*a* for holding the rotary shaft 83*a* of the fixing roller 83 by a bearing 103 such that the rotary shaft 83*a* can be rotated freely. The second frame 102 has a substantially U-shaped groove 102*a* for holding the rotary shaft 84*a* of the heating roller 84 by a bearing 104 such that the rotary shaft 84*a* can be rotated freely.

The first frame 101 and the second frame 102 are coupled to slide in a direction of separating from one another while being in contact with one another. That is, pins 101*b* and 101*c* are inserted into two slits 102*b* and 102*c* formed on the second frame 102, and top ends of the pins 101*b* and 101*c* are fixed on the first frame 101. The first frame 101 and the second frame 102 are urged in a direction of separating from one another, by a spring 105 having one end fixed on the first frame 101 and the other end fixed on the second frame 102.

Holes 107*a* and 107*b* through which a cable 106*a* extending from one end of the halogen lamp 88 provided inside the heating roller 84 passes are formed on the first frames 101 of the movable frames 100. That is, the cable 106*a* extending from one end of the halogen lamp 88 passes inside the fixing belt 85 through the hole 107*a* of the movable frame 100 on the one end side and is led to the other end side through the hole 107*b* of the movable frame 100 on the other end side.

A gear 108 for engaging with the gear 95 attached to the rotary shaft 82*a* of the pressurizing roller 82 is attached to the rotary shaft 83*a* of the fixing roller 83, which passes through the hole 101*a* of the movable frame 100 on the other end side.

When the belt unit 86 is assembled, both ends of the rotary shaft 83*a* of the fixing roller 83 are put into the holes 101*a* of two movable frames 100 and both ends of the rotary shaft 84*a* of the heating roller 84 are put into the grooves 102*a* of the movable frames 100. In this state, the fixing roller 83 and the heating roller 84 are pushed in a direction of becoming closer to one another, the movable frames 100 are compressed against the urging force of the spring 105, and the endless fixing belt 85 is mounted from one end side of the rollers 83 and 84. At this time, the cable 106*a* extending from one end side of the heating roller 84 is led to the other end side through the holes 107*a* and 107*b* of the movable frames 100 and, therefore, the cable 106*a* does not disturb the mounting of the fixing belt 85.

When the belt unit 86 thus assembled is mounted in the casing 81, the movable frames 100 of both ends are mounted in the groove holes 87*a* and 87*b* of both side wall portions 81*a* and 81*b* of the casing 81. Step portions are formed on inner sides of the groove holes 87*a* and 87*b* facing one another, along the groove holes. These step portions function to hold the movable frames 100 after the belt unit 86 is mounted in the casing 81. Thus, when the belt unit 86 is mounted in the casing 81, the pressurizing roller 82 is pushed down by the belt unit 86 and a pressurizing force is generated therebetween. To maintain the pressurizing force, the rotary shaft of the fixing roller 83 is held by lock levers 109 provided on the outer side of the side wall portions 81*a* and 81*b*.

Incidentally, for example, a device disclosed in the above-mentioned Jpn. Pat. Appln. KOKAI Publication No. 2000-66541 is known, as a device for detachably mounting a belt unit including a fixing belt on a fixing device body as seen in this embodiment. In this conventional device, a fixing belt is put round a heating roller and a fixing roller as a unit, which is detachable from the device body. In this device, however, the entire unit needs to be exchanged to exchange the fixing belt, which has the shortest life.

In the fixing device of this embodiment, since the belt unit 86 is detachable from the casing 81 and only the fixing belt 85 can be extracted from the belt unit 86, the fixing belt 85 having a comparatively short life can be easily exchanged. That is, the fixing belt 85 can be extracted from one end side under the condition that the belt unit 86 is pushed in a direction in which the fixing roller 83 and the heating roller 84 are moved closer to one another.

As described above, according to this embodiment, the fixing belt having a comparatively short life can be easily exchanged and the maintenance cost can be reduced.

The present invention is not limited to the above-described embodiments, but can be variously modified within the gist of the present invention.

What is claimed is:

1. A fixing device for allowing a sheet-like recording medium on which a developer image is transferred to pass through a conveyance path and fixing the developer image on the recording medium, said fixing device comprising:

a first roller and a second roller arranged opposite to one another to sandwich and mutually pressurize the conveyance path, said first roller arranged on the surface side of the recording medium conveyed in the conveyance path;

an endless belt put round a part of said first roller, for running while an outer surface thereof is in contact with the surface of the recording medium conveyed in the conveyance path, said belt being longer than an outer periphery of said first roller; and a heater for heating said belt;

wherein said heater heats a part of said belt where said belt is not put round said first roller; and wherein said heater heats said belt from the outer surface side thereof.

2. A fixing device according to claim 1, wherein a heat insulation layer is formed on an inner surface side of said belt.

3. A fixing device according to claim 1, further comprising a roller provided to be in contact with an outer surface of said belt, at a part of said belt where said belt is put round said first roller, to apply a release agent to the outer surface of said belt.

4. A fixing device according to claim 3, wherein said roller is provided on a downstream side of a running direction of said belt, from a fixing portion where the outer surface of said belt is in contact with the surface of the recording medium conveyed in the conveyance path.

5. A fixing device according to claim 1, further comprising:

a first sensor for detecting a temperature of the outer surface of said belt;

a second sensor for detecting a temperature of an outer peripheral surface of said second roller, which is in contact with the outer surface of said belt via the conveyance path; and control means for monitoring the temperatures detected by said first and second sensors, and allowing said belt to intermittently run such that the temperature of the outer surface of the belt is raised to a first desired temperature and, simultaneously, the temperature of the outer peripheral surface of the second roller is raised to a second desired temperature.

6. A fixing device according to claim 5, wherein said first sensor is provided to be in contact with the outer surface of said belt, at a part of said belt where said belt is put round said first roller.

7. A fixing device according to claim 6, wherein said first sensor is provided on an upstream side of the running direction of said belt, from the fixing portion where the outer surface of said belt is in contact with the surface of the recording medium conveyed in the conveyance path.

8. A fixing device for allowing a sheet-like recording medium on which a developer image is transferred to pass through a conveyance path and fixing the developer image on the recording medium, said fixing device comprising:

a first roller and a second roller arranged opposite to one another to sandwich and mutually pressurize the conveyance path, said first roller arranged on the surface side of the recording medium conveyed in the conveyance path;

an endless belt put round said first roller and stretched, for running while an outer surface thereof is in contact with the surface of the recording medium conveyed in the conveyance path;

a third roller having an outer peripheral surface that is in contact with an inner surface of said belt, and being urged in a direction of separating from said first roller so as to apply tension to said belt, said third roller having a smaller diameter portion that is made narrow to reduce an area of the outer peripheral surface; and a heater for heating said belt.

9. A fixing device according to claim 8, wherein said heater heats said belt from the outer surface side thereof.

10. A fixing device according to claim 9, wherein a heat insulation layer is formed on an inner surface side of said belt.

11. An image forming apparatus comprising:

image forming means for forming a developer image on an image carrier;

a transfer device for transferring the developer image formed by said image forming means on a surface of a sheet-like recording medium;

a conveyance path in which the recording medium on which the developer image is transferred by said transfer device is conveyed; and a fixing device for fixing the developer image on the recording medium conveyed in the conveyance path, said fixing device comprising:

a first roller and a second roller arranged opposite to one another to sandwich and mutually pressurize the conveyance path, said first roller arranged on the surface side of the recording medium conveyed in the conveyance path;

an endless belt put round a part of said first roller, for running while an outer surface thereof is in contact with the surface of the recording medium conveyed in the conveyance path, said belt being longer than an outer periphery of said first roller; and a heater for heating said belt;

wherein a heat insulation layer is formed on an inner surface side of said belt.

12. An image forming apparatus according to claim 11, wherein said heater heats a part of said belt where said belt is not put round said first roller.

13. An image forming apparatus according to claim 12, wherein said heater heats said belt from the outer surface side thereof.

14. An image forming apparatus according to claim 11, further comprising a roller provided to be in contact with an outer surface of said belt, at a part of said belt where said belt is put round said first roller, to apply a release agent to the outer surface of said belt.

15. An image forming apparatus according to claim 14, wherein said roller is provided on a downstream side of a running direction of said belt, from a fixing portion where the outer surface of said belt is in contact with the surface of the recording medium conveyed in the conveyance path.

16. An image forming apparatus according to claim 11, further comprising:

a first sensor for detecting a temperature of the outer surface of said belt;

a second sensor for detecting a temperature of an outer peripheral surface of said second roller, which is in contact with the outer surface of said belt via the conveyance path; and control means for monitoring the temperatures detected by said first and second sensors, and allowing said belt to intermittently run such that the temperature of the outer surface of the belt is raised to a first desired temperature and, simultaneously, the temperature of the outer peripheral surface of the second roller is raised to a second desired temperature.

17. An image forming apparatus according to claim 16, wherein said first sensor is provided to be in contact with the outer surface of said belt, at a part of said belt where said belt is put round said first roller.

18. An image forming apparatus according to claim 17, wherein said first sensor is provided on an upstream side of the running direction of said belt, from the fixing portion where the outer surface of said belt is in contact with the surface of the recording medium conveyed in the conveyance path.

* * * * *